US006193617B1

(12) United States Patent
Mertens

(10) Patent No.: US 6,193,617 B1
(45) Date of Patent: Feb. 27, 2001

(54) GOLF BALL AND METHOD OF MAKING SAME

(75) Inventor: Peter Mertens, Naperville, IL (US)

(73) Assignee: PureSpin Golf Company, Inc., Oswego, IL (US)

( * ) Notice: Subject to any disclaimer, the term of this patent is extended or adjusted under 35 U.S.C. 154(b) by 0 days.

(21) Appl. No.: 09/266,085

(22) Filed: Mar. 10, 1999

(51) Int. Cl.[7] ..... A63B 37/00
(52) U.S. Cl. ..... 473/351; 473/365; 473/363
(58) Field of Search ..... 473/351, 365, 473/363, 364, 378, 377; 273/218, 219, 220, 230

(56) References Cited

U.S. PATENT DOCUMENTS

| | | | | |
|---|---|---|---|---|
| 1,795,732 | | 3/1931 | Miller . | |
| 2,861,810 | | 11/1958 | Veatch . | |
| 3,359,231 | | 12/1967 | Kent . | |
| 3,438,933 | | 4/1969 | Bartsch . | |
| 4,085,937 | | 4/1978 | Schenk . | |
| 4,295,652 | | 10/1981 | Saito et al. . | |
| 4,768,787 | * | 9/1988 | Shira | 273/175 |
| 4,964,641 | * | 10/1990 | Miesh et al. | 273/175 |
| 5,150,905 | | 9/1992 | Yuki et al. . | |
| 5,427,378 | | 6/1995 | Murphy . | |
| 5,688,190 | * | 11/1997 | Rowland | 473/330 |
| 5,692,974 | | 12/1997 | Wu et al. . | |
| 5,827,567 | * | 10/1998 | Molitor | 427/135 |

* cited by examiner

*Primary Examiner*—Lee Young
*Assistant Examiner*—Sean Smith
(74) *Attorney, Agent, or Firm*—Cantor Colburn LLP

(57) ABSTRACT

The present invention is directed to a golf ball having a core surrounded by an outer cover. The outer cover is formed of conventional materials such as a natural or synthetic resin and in accordance with the present invention, a plurality of hard particles is disposed within the outer cover such that a predetermined number of the hard particles protrude from an outer surface of the outer cover. Preferably, the plurality of hard particles comprises diamond particles and the plurality of diamond particles are present in the golf ball cover such that about 1% to about 40% of the total outer surface area of the outer cover is occupied by the plurality of diamond particles.

16 Claims, 2 Drawing Sheets

GOLF BALL AND METHOD OF MAKING SAME

TECHNICAL FIELD

The present invention relates to golf balls and methods of manufacture thereof. More particularly, this invention relates to a durable, increased grip golf ball having hard particles disposed therein and protruding from an outer surface of the golf ball.

BACKGROUND OF THE INVENTION

Golf balls are required to ensure flight stability, long flight distance characteristics and must be durable to withstand repeated impact with a golf club head. In addition to these characteristics, other desirable features of the golf ball are good compression, good cut, and shatter resistance. The golf ball should have an elastic modulus providing the capability for storing the energy of deformation and quickly releasing it to regain sphericity after being sharply struck by a golf club head. The golf ball should further provide a good click sound when fairly hit, and should have inherently good balance to thereby provide aerodynamic stability and true roll on a putting green or other surface. Over the years, the preferred material used in manufacturing golf balls has been rubber compositions. The rubber compositions used in golf ball covers are therefore required to have well controlled properties such as bounce impact elasticity, compressive strength and hardness to name but a few. One other consideration to take note of when manufacturing a golf ball is the United States Golf Association's series of rules which govern golf balls.

The United States Golf Association has implemented a series of rules with respect to the physical characteristics and performance properties of golf balls to create a uniform system of play. Included within these series of rules are specific provisions that govern that: (a) the weight of a golf ball shall not be greater than 1.620 ounces (45.93 gm); (b) the diameter of a golf ball shall be not less than 1.680 inches 42.67 mm); (c) the velocity of the golf ball shall not be greater than 250 ft (76.2 m) per second plus a tolerance of 2%; (d) the overall distance that the golf ball will travel shall not be cover an average distance in carry and roll exceeding 280 yards plus a tolerance of 6%. In view of these physical and performance properties, golf ball manufacturers seek to produce golf balls which balance these properties and exhibit superior play.

Golf balls have evolved from their early form which simply consisted of a stuffed cover to golf ball covers formed of either a naturally occurring rubber called balata or gutta percha which comprises a packing material used in the transportation of cargo. While balata is a more desirable material because it is a softer material which has a higher potential to impart high spin and controllability to the golf balls. Unfortunately, balata is a very difficult material to use in the manufacturing process for fabricating the golf balls.

Even more recently, in the late 1960's, a new material for forming golf ball covers was introduced by DuPont under the trade name SURLYN. SURYLN materials are a class of ethylene-methacrylic acid based ionomers. In addition, lately, various companies have investigated using polyurethane as a golf ball cover material.

The golf ball cover material also includes other components which are added to improve various properties of the golf ball. For example, it is a common practice to add a brightener or whitener to the golf ball cover material since most golf ball cover materials, e.g., SURLYN or balata, are not a pure white in color and as even the most novice golfer would know the vast majority of golf balls are distributed and marketed in a white color. The main purpose of enhancing the brighteness or whiteness of the golf ball is to make it aesthetically pleasing. The golf ball cover material may further include filler materials, polymerization initiators, U.V. stabilizers, light stabilizers, antioxidants, and the like.

SUMMARY OF THE INVENTION

The present invention is directed to a golf ball having a core surrounded by an outer cover. The outer cover is formed of conventional materials such as a natural or synthetic resin and in accordance with the present invention, a plurality of hard particles is disposed within the outer cover so that a predetermined number of the hard particles protrude from an outer surface of the outer cover. Preferably, the plurality of hard particles comprises diamond particles and the plurality of diamond particles are present in the golf ball cover such that about 1% to about 40% of the total outer surface area of the outer cover is occupied by the plurality of diamond particles and more preferably about 10% to about 40% of the total outer surface is occupied.

Because a predetermined number of hard particles protrudes from the outer surface of the outer cover, the golf ball of the present invention has enhanced friction characteristics on the outer surface. By increasing the friction characteristics of the outer surface of the outer cover, the golf ball of the present invention grips the striking face of a golf club head more than conventional golf balls resulting in more spin being imparted on the golf ball. In addition, due to the hardness characteristics of the hard particles, e.g., diamond particles, the outer surface of the golf ball comprises a hardened surface which permits greater driving capabilities and offers a durable outer cover for the golf ball.

The above-discussed and other features and advantages of the present invention will be appreciated and understood by those skilled in the art from the following detailed description and drawings.

BRIEF DESCRIPTION OF THE DRAWINGS

The present invention will now be described by way of example with reference to the following Figures, which are meant to be exemplary, not limiting, and in which.

DETAILED DESCRIPTION OF THE INVENTION

Figure 1:
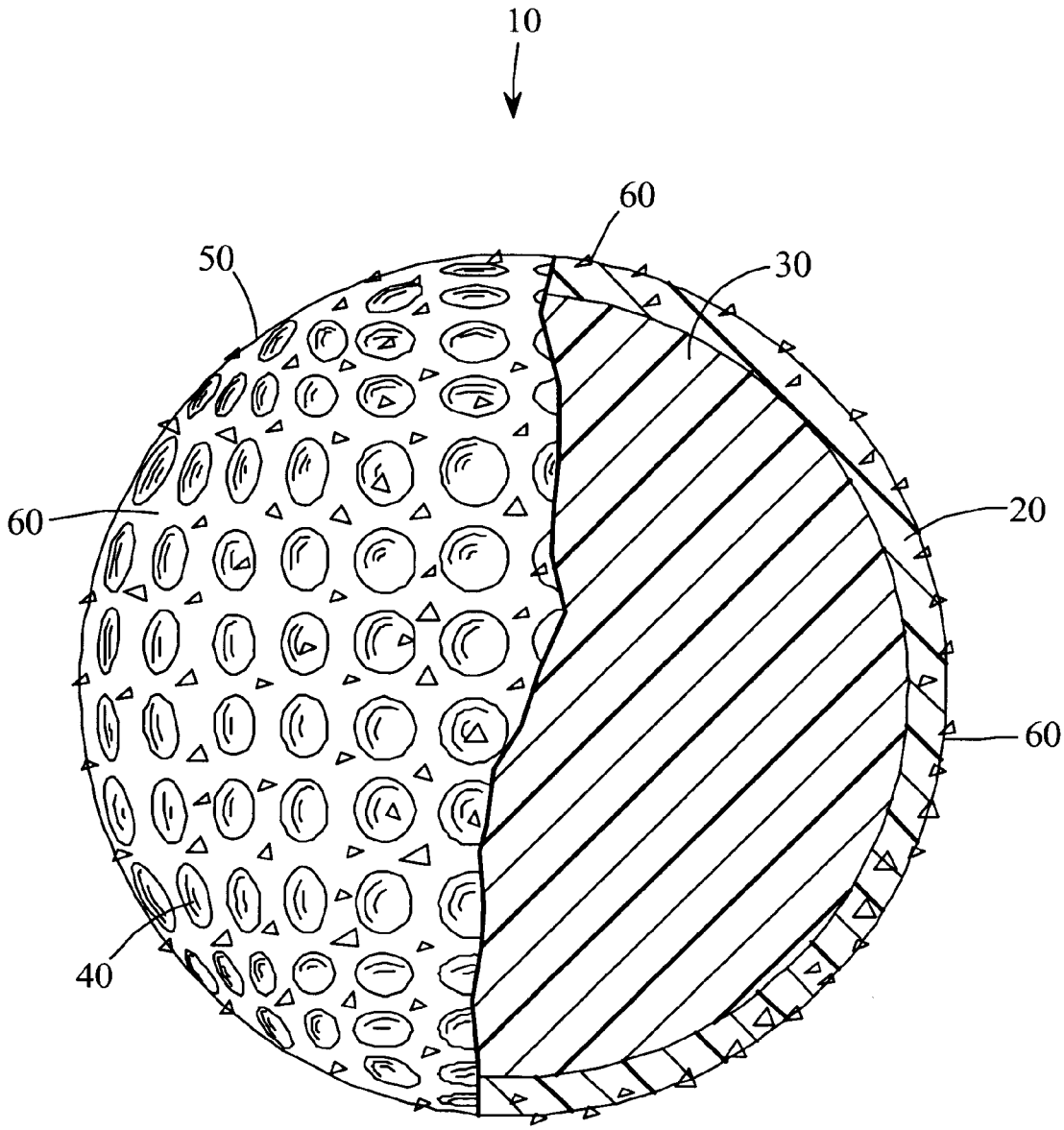
FIG. 1 is an enlarged perspective view of a golf ball in accordance with the present invention.
Figure 2:
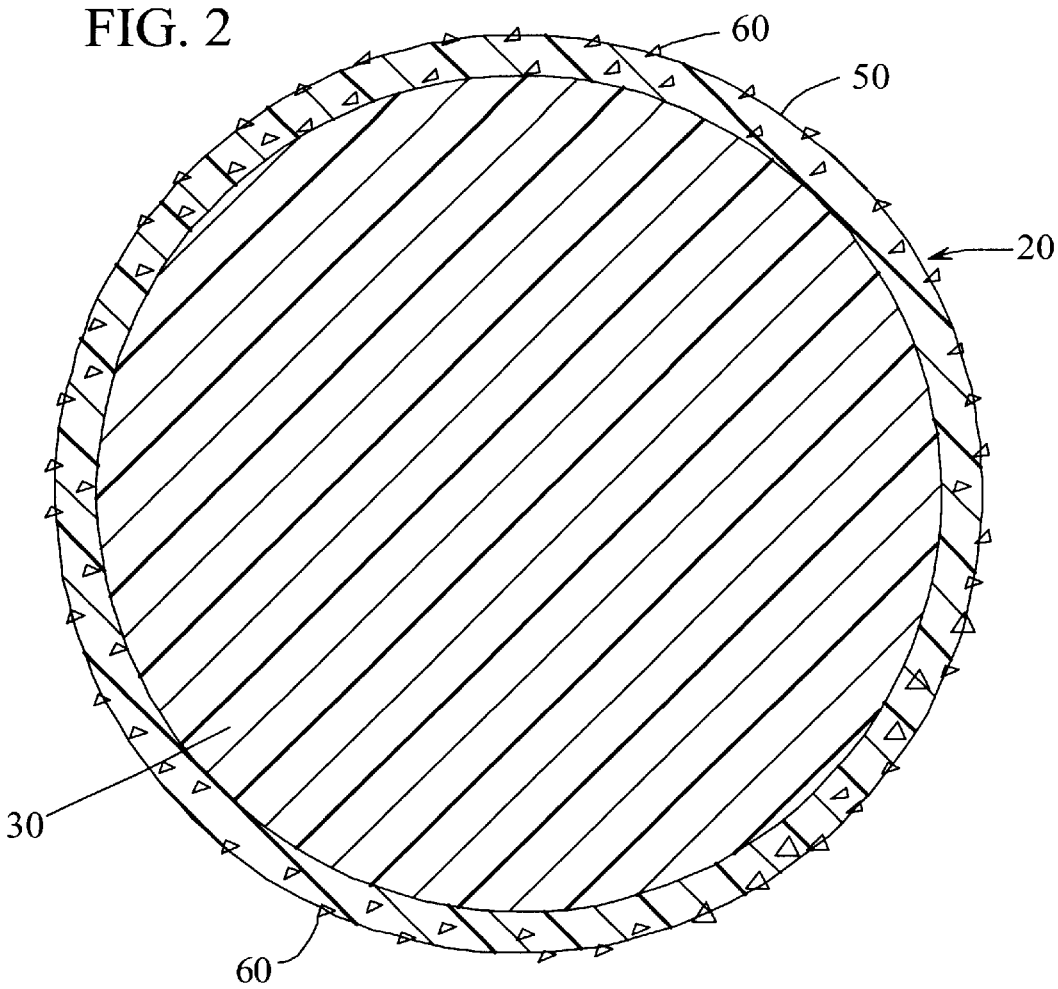
FIG. 2 is a cross-sectional view of the golf ball of FIG. 1.
Figure 3:
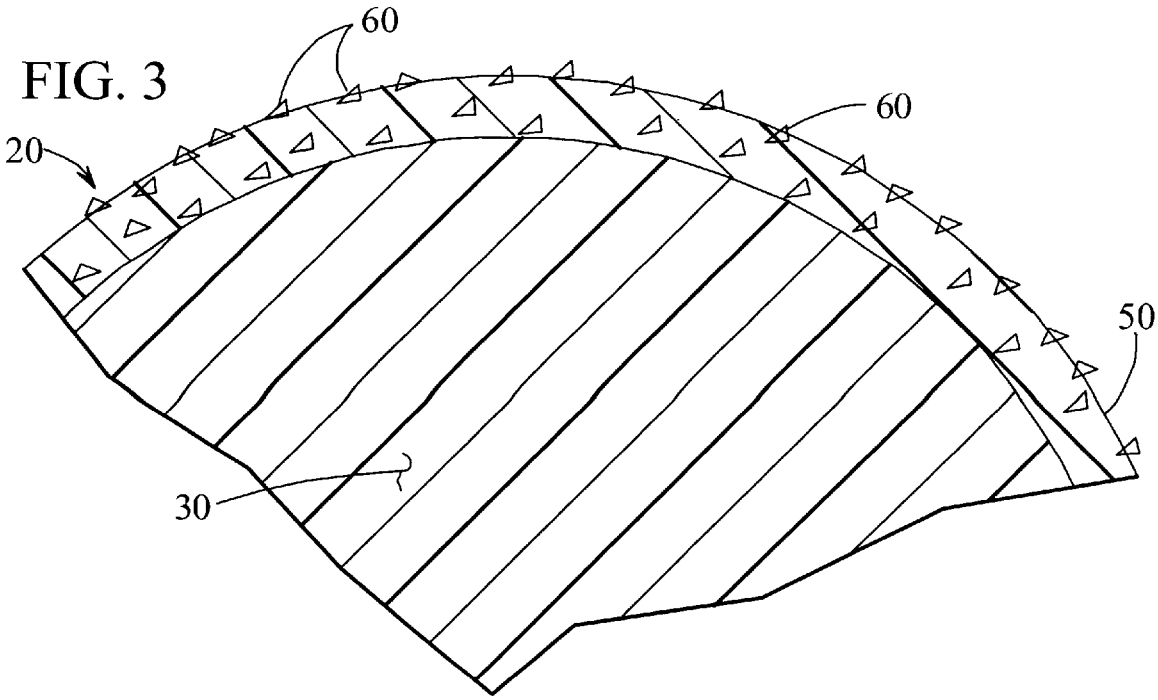
FIG. 3 is an enlarged partial cross-sectional view of the golf ball of FIG. 1.

Turning to FIGS. 1–3, a durable, increased spin golf ball made in accordance with the principles of the present invention is illustrated and generally indicated at 10. Golf ball 10 includes a cover 20 disposed about a core 30. Golf ball cover 20 may be formed of any suitable material and in an exemplary and preferred embodiment, cover 20 is made from a natural resin such as balata, or from a synthetic resin such as SURLYN. Cover 20 has a plurality of conventional indentations or dimples 40 formed in outer surface 50 thereof. A typical golf ball 10 will have a wall thickness of about 0.068 inch (1.7 mm). An exemplary golf ball core 30 comprises a rubber sphere filled with a liquid substance therein or a solid sphere made of an elastic substance, such as cis-polybutadiene. However, it is within scope of the present invention that any suitable material may be used to form core 30.

In accordance with the present invention, a plurality of hard particles 60 is disposed within cover 20 so that a predetermined number of hard particles 60 protrudes from surface 50 to form a hard, durable golf ball surface 50. It being understood that the plurality of hard particles disposed at surface 50 each have a first portion which protrudes from surface 50 and a second portion which is securely anchored within the material which comprises cover 20. It is further understood that a predetermined number of hard particles 60 will be disposed entirely within the material forming cover 20 as they are entirely encaptured within the material during the process of forming cover 20. The plurality of hard particles 60 includes but is not limited to boron compounds; alumina compounds; partially stabilized zirconia; carbides, including tungsten carbide, chrome carbide, vanadium carbide, boron carbide, complex carbides, silicon carbide, ceramics, beryllium compounds, and other naturally occurring minerals. More preferably, the plurality of hard particles 60 comprises a plurality of diamond particles having a particle size from about 1 micron to about 40 micron. Diamond particles 60 are commercially available from a number of sources including General Electric Diamond Division. Diamond particles 60 act as a filler material when disposed in the material forming cover 20.

As is known, golf ball cover 20 material may include conventional additives. Typically, golf ball cover 20 includes one or more fillers exemplified by graphite, chopped glass fiber, chopped synthetic fibers, such as polyester fiber, inorganic fibrous fiber filler such asbestos, glass flake, finely divided silica hydrate, lead carbonate, calcium carbonate, clays, alumina, litharge and baryte, nucleating agents such as alkaline each metal carbonates, the sodium salts of higher fatty acids, the sodium salt of montan wax acid and powdered polybutylene terephthalate, and lubricants such as hydrocarbon type waxes, fatty acids, fatty acid amide, bis-fatty acid amides, ester waxes, and metallic soaps.

One type of additive which is used as a filler and also a brightening (whitening) agent comprises white pigments. These white pigments include but are not limited to titanium dioxide, calcium carbonate, zinc oxide, and zinc sulfide. White pigments may be used in any amount which is suitable to provide a uniform white color of the desired brighteness to golf ball covers 20 of the present invention. In particular, these white pigments may be used in amounts from about 0.001% to about 5.0%. One exemplary range of white pigment is from about 2% to about 4%.

As is known in the manufacturing of golf balls, conventional heat and radiation stabilizing agents including ultraviolet light absorbents (U.V. absorbers) and antioxiodants can also be incorporated into the compositions for manufacturing golf ball covers 20 of the present invention. Furthermore, any combination of U.V. stabilizers and light stabilizers can also be used. Other dyes, as well as optical brighteners and fluorescent pigments and dyes may also be used in golf ball covers 20 according to the present invention. Such additional ingredients may be used in any amounts that will achieve their desired purpose. However, conventional amounts include the range from about 0.05% to about 1.5%.

Golf ball 10 and more specifically golf ball cover 20 are manufactured according to known methods and preferably golf ball cover 20 is either compression molded or it can be injection molded as a fluid about golf ball core 30.

Accordingly, the materials forming golf ball cover 20 are weighed and may be initially mixed in a predetermined order in an internal mixer such as a Banbury mixer. These materials comprise the natural resin, such as balata, or the synthetic resin, such as SURLYN, along with filler materials, whitening agents, and other conventional components ("base materials"). After the base materials have been thoroughly intermingled, the plurality of hard particles 60 is compounded with the base materials. The compound process comprises any suitable process which disperses the plurality of diamond particles 60 throughout the base materials. One such compounding process is a milling process which, as is known in the art, comprises mechanical treatment of materials to produce a powder. Accordingly, the plurality of diamond particles 60, which is in the form of a fine powder having a particle size from about 1 micron to about 40 micron is milled with the remaining base materials to form a resultant power used to manufacture golf ball cover 20 material of the present invention by subjecting the resultant power to a compression molding or injection molding process.

The plurality of diamond particles 60 acts as a filler material and thus, a predetermined amount of the more conventional fillers which are present in the golf ball cover 20 material of the present invention is preferably removed and replaced by the plurality of hard particles 60 in manufacturing golf ball 10. For example, the amount of white pigment, e.g., titanium dioxide, in the present golf ball cover 20 material may be reduced and the reduced amount replaced with a predetermined amount of hard particles 60 which acts also a filler material. Alternatively, the total amount of filler material is initially calculated including the predetermined amount of the hard particles 60 as filler material. In all embodiments, the ratio of the plurality of hard particles 60 to surface area 50 of golf ball 10 may be varied so as to increase the amount of hard particles 60 which protrude from surface 50 resulting in a hardened surface 50 for greater driving distance and increase spin being imparted on golf ball 10 when impact during a golf swing.

After milling, in one exemplary embodiment, the golf ball cover 20 material is subjected to a compression molding process to form golf ball 10. Golf balls 10 of the present invention may be manufactured in any conventional manner. For example, after the above-identified various ingredients are mixed together, the composition thus obtained is molded to a sheet and, then, the sheet is fabricated or shaped in a cold state to form half-cups or half-shells. Golf ball core 30 is encapsulated in golf ball cover 20 by applying the preformed halves of a vulcanizable cover material, such as balata, or a thermoplastic cover material, such as SURLYN ionomer about golf ball core 30, and precision molding the covered core in golf ball dies having appropriate form to provide the dimpled surface to the resulting golf ball 10. This compression molding process is conducted under predetermined temperatures and pressures to produce golf ball 10 of the present invention. It being understood that the preformed halves of golf ball cover 20 have a predetermined number of hard particles 60 protruding from surface 50. As previously mentioned because of the milling process and compounding process, a predetermined number of hard particles 60 will be entirely disposed within the material forming cover 20 and will not protrude above surface 50.

In FIGS. 1–3, the plurality of hard particles 60 are enlarged for clarity of illustration. The addition of hard particles 60 to cover 20 such that a predetermined number of hard particles 60 protrudes from surface 50 enhances the friction characteristics of surface 50 when golf ball 10 is struck and driven by a golf club head (not shown). By increasing the friction characteristics of golf ball 10, golf ball 10 grips the striking face of the golf club head more than conventional golf balls. This results in more spin being imparted on golf ball 10 upon impact with the golf club head. By having more control over the spin of golf ball 10 and being able to impart additional spin to golf ball 10, a golfer may manipulate golf ball 10 more than conventional golf balls and play the green with this spin in mind. In addition, because a predetermined number of hard particles 60 protrudes above surface 50, surface 50 comprises a hardened surface in comparison to other conventional golf balls. This is especially true when diamond particles are used as the plurality of hard particles 60 because as is known, diamond particles have superior hardness characteristics. By increasing the hardness of surface 50, the driving distance of golf ball 10 is increased when golf ball 10 is struck by the golf club head. Thus, a golfer can improve the driving game by increasing distance and also maintain control of golf ball 10 so that accuracy is not jeopardized. Furthermore due to the hardness of hard particles 60 disposed throughout surface 50, surface 50 comprises a durable surface that can take the repeated contact arising between a golf club head (not shown) and golf ball 10 during play.

Alternatively, golf ball 10 is formed by an injection molding process. As is known in the art, injection molding is a processing technique for converting thermoplastic and thermosetting materials into final products, such as golf ball 10. Most conventional injection molding processes comprise either a reciprocating-screw system or a two-stage screw system. Both systems involve the plasticization of the thermoplastic or thermosetting material, wherein the hot, plasticized material is injected into a mold where it is maintained under pressure. When the plastic material has sufficiently solidified, the mold opens and the plastic piece(s) is ejected.

When an injection molding process is used to form golf ball 10, the natural or synthetic resin is added to an injection molding device which heats and plasticizes the material creating a plastic material in a liquid state. An exemplary thermoplastic cover material for use in golf ball cover 20 is SURLYN material, which can be injection molded about golf ball core 30 in a manner known in the art. Other additives are also added and intermingled with the natural or synthetic resin during the process. The plurality of hard particles 60 are introduced in the injection molding process so that a mixture results with the plurality of hard particles 60 being intermingled with the other materials. This liquid polymer (resinous plastic) with the plurality of hard particles 60 disposed therein is injected into a mold about core 30 and the plurality of the hard particles 60 are disposed within the resin such that a predetermined number of hard particles 60 protrudes from surface 60 of golf ball 10 when the mixture is injected into the mold.

When injection molding is used to form golf ball 10 of the present invention, golf ball core 30 is preferably placed in the center of a mold cavity and golf ball cover 20 material is injected around golf ball core 30 resulting in golf ball 10 being formed, wherein surface 50 includes the plurality of hard particles 60. It is within the scope of the present invention that other suitable processes for forming golf ball cover 20 of the present invention may also be employed.

In accordance with the present invention, golf ball 10 includes the plurality of hard particles 60 which are present in golf ball cover 20 such that the plurality of hard particles 60 occupies about 1% to about 50 % of the outer surface area 50 of cover 20, preferably about 10% to about 40% of outer surface 50 by volume is occupied by the plurality of hard particles 60 and more preferably about 20% by volume of outer surface 50 is occupied by the plurality of hard particles 60.

The amount of hard particles 60 on surface 50 can be varied as a percentage of the area on surface 50. For example, a standard golf ball has a diameter of about 1.68 inches and a surface area of approximately 8.86 sq. inch ($S=\pi D^2$). Thus, in accordance with the present invention, when the plurality of diamond particles 60 comprises about 10% of surface 50 then approximately about 0.886 sq inch of surface 50 would be covered and when the plurality of diamond particles 60 comprises about 40% of surface 50 then approximately about 3.54 sq inch would be covered.

While preferred embodiments have been shown and described, various modifications and substitutions may be made hereto without departing from the spirit and scope of the present invention. Accordingly, it is to be understood that the present invention has been described by way of illustrations and not limitation.

What is claimed is:

1. A golf ball, comprising:

a core;

an outer cover surrounding the core, the outer cover having an outer surface; and a plurality of hard particles disposed within the outer surface of the outer cover such that at least a portion of the plurality of hard particles protrudes above the outer surface of the outer cover.

2. The golf ball of claim 1, wherein the outer cover comprises a material selected from the group consisting of natural resins and synthetic resins.

3. The golf ball of claim 1, wherein the outer cover comprises ethylene-methacrylic acid based ionomers.

4. The golf ball of claim 1, wherein the plurality of hard particles is selected from the group consisting of boron compounds; alumina compounds; partially stabilized zirconia; carbides, including tungsten carbide, chrome carbide, vanadium carbide, boron carbide, complex carbides, silicon carbide; ceramics; beryllium compounds; diamond particles and other naturally occurring minerals.

5. The golf ball of claim 1, wherein the plurality of hard particles comprises diamond particles.

6. The golf ball of claim 5, wherein the plurality of diamond particles have a particle size from about 1 micron to about 40 micron.

7. The golf ball of claim 5, wherein the plurality of diamond particles has a particle size of about 20 micron.

8. The golf ball of claim 1, wherein the plurality of hard particles comprises approximately about 1% to about 50% of a surface area of the outer cover.

9. The golf ball of claim 1, wherein the plurality of hard particles occupies about 10% to about 40% of a total surface area of the outer surface.

10. The golf ball of claim 1, wherein the outer cover including the plurality of hard particles is formed by a compression molding process or by an injection molding process.

11. A golf ball, comprising:

a core;

an outer cover disposed about the core, the outer cover having an outer surface area; and a plurality of diamond particles disposed within the outer cover, wherein at least a portion of the diamond particles protrudes from the outer surface area of the outer cover, wherein the diamond particles occupy from about 10% to about 40% of the total outer surface area.

12. The golf ball of claim 11, wherein the outer cover comprises a material selected from the group consisting of natural resins and synthetic resins.

13. A golf ball, comprising:

a core;

an outer cover surrounding the core; and a plurality of diamond particles disposed within the outer cover.

14. The golf ball according to claim 13, wherein at least a portion of the plurality of diamond particles protrude above an outer surface of the outer cover.

15. The golf ball according to claim 13, wherein the outer cover comprises a material selected from the group consisting of natural resins and synthetic resins.

16. The golf ball according to claim 13, wherein the plurality of diamond particles comprises approximately about 1% to about 50% of a surface area of the outer cover.

* * * * *